US006840831B2

(12) United States Patent
Katz et al.

(10) Patent No.: US 6,840,831 B2
(45) Date of Patent: Jan. 11, 2005

(54) KICKBOARD

(76) Inventors: Robert Katz, 3570 Ridgewood, Apt. 305, Montréal, Quebec (CA), H3V 1C2; Sylvain Duchesne, 5338 Chabot, Montréal, Quebec (CA), H2H 1Y8

( * ) Notice: Subject to any disclaimer, the term of this patent is extended or adjusted under 35 U.S.C. 154(b) by 0 days.

(21) Appl. No.: 10/356,608

(22) Filed: Feb. 3, 2003

(65) Prior Publication Data

US 2003/0143905 A1 Jul. 31, 2003

Related U.S. Application Data

(63) Continuation-in-part of application No. 09/761,674, filed on Jan. 18, 2001, now abandoned, which is a continuation-in-part of application No. 09/655,485, filed on Sep. 5, 2000, now abandoned.

(51) Int. Cl.[7] ..... A63C 15/00
(52) U.S. Cl. ..... 441/65; 441/74
(58) Field of Search ..... 114/357, 65, 74; 441/65, 74

(56) References Cited

U.S. PATENT DOCUMENTS 4,781,638 A 11/1988 Winters, Jr.
5,797,779 A 8/1998 Stewart

*Primary Examiner*—Ed Swinehart

(57) ABSTRACT

A kickboard having a rigid base of generally thin, rectangular, shape. At least one shallow cutout or depression is formed in the top surface of the base, the depression extending rearwardly from near the front edge of the base and being at least wide enough and long enough to receive a swimmer's arm when the swimmer grips the front edge of the base with his hand. A layer of cushioning material can be provided in the depression to cushion the arm of the swimmer while gripping the board by the front edge. The front edge of the board is rounded and at least partly cushioned as well. A groove is provided in the bottom surface of the base positioned to receive the finger-tips of the swimmer while gripping the front edge. A second groove can be provided in the top surface of the base, just behind the finger-tip groove, for receiving a portion of the palm of the swimmer's hand while gripping the front edge.

17 Claims, 6 Drawing Sheets

KICKBOARD

CROSS-REFERENCES TO RELATED APPLICATIONS

This application is continuation-in-part of application Ser. No. 09/761,674 filed Jan. 18, 2001 now abandoned which in turn is a continuation-in-part of application Ser. No. 09/655,485, filed Sep. 5, 2000 now abandoned.

BACKGROUND OF THE INVENTION

1. Field of the Invention

This invention is directed toward a kickboard.

2. Description of the Related Art Including Information Disclosed Under CRF §§ 1.97-1.99

Kickboards are used in swimming to help a swimmer develop a strong leg kick. The board is made from material which will float and the swimmer holds the board in front of him with his hands, so as to immobilize his arms, while he propels himself through the water by kicking. The board is usually held on the sides although it can also be held on its front edge.

If the board is held on the sides it can become tiring for the swimmer's hands and also for the arm joints since the hands are turned relative to the shoulders. To reduce stress on the joints it is preferred to hold the board at the front edge. However, if the board is held on the front edge it can become tiring for the swimmer to maintain his arms on the board while gripping the front edge. It can also become tiring having the swimmer's arms resting on the board, due to pressure points where the arm contacts the board, and for his fingers gripping the board.

SUMMARY OF THE INVENTION

It is the purpose of the present invention to provide kickboard that is held on the front edge and that provides support for the swimmer's arms resting on the board. It is another purpose of the present invention to provide a kickboard that provides comfortable support for the swimmer's arms resting on the board. It is another purpose of the present invention to provide a kickboard that allows a comfortable and relaxed grip to be taken on the kickboard. It is a further purpose of the present invention to provide a kickboard that can be used in a comfortable manner when using only one hand on the kickboard.

In accordance with the present invention, the kickboard has a top surface shaped to provide at least one depression cradling a swimmer's arm to help retain the arm in position on the board. Also in accordance with the present invention, the kickboard is provided with at least one cushioned area to support at least one arm of the swimmer while he holds the front edge of the board during swimming. Preferably, the cushioned area is in the depression. Also, in accordance with the present invention, the kickboard is provided with shaping at, and adjacent, the front edge of the board which allows the swimmer to comfortably and naturally grip the board with at least one hand. Preferably, at least part of the shaping areas are cushioned as well.

The invention is particularly directed toward a kickboard having a rigid base defining the general shape of the kickboard, the base having long side edges and shorter front and back edges joining generally parallel top and bottom surfaces. The top surface of the base has at least one shallow depression, extending rearwardly from near the front edge to adjacent the rear edge. The depression helps to retain the swimmer's arm in position on the board. The bottom of the depression can be concave when seen in transverse cross-section to help retain the arm in position. The depression can receive a layer of cushioning material, the layer adhered to the base. The layer of cushioning material comfortably supports the swimmer's arm. The depression can be centrally located on the board and made wide enough to receive only one arm. Alternatively, a pair of depressions can be provided, one on each side of the board, each receiving an arm of the swimmer. Preferably, three side-by-side depressions are provided in the top surface of the board, the depressions substantially taking up the width of the board. The three depressions allow the swimmer to use the board with both arms in depressions adjacent the sides of the board or to use the board with one arm in the central depression in the center of the board.

The invention also is particularly directed toward a kickboard having improved gripping means. A rear-palm receiving groove is provided in the top surface of the base close to the front edge and parallel to it. A finger-tip receiving groove is also provided in the bottom surface of the base, the groove spaced a short distance from the front edge and parallel to it. The front edge is preferably rounded. When the swimmer grips the front edge of the kickboard with his hands, the fingers curl about the rounded front edge with the finger tips entering the bottom groove and with the heel portion of the palms entering the top groove. The cushioning layer can extend forwardly from the depressions over the top groove and at least part way over the rounded front edge of the board.

The rounded, cushioned, front edge; the bottom finger-tip receiving groove; and the rear-palm receiving groove allow a person to very comfortably, yet securely, grip the kickboard. The shaping and construction of the board allows the board to be gripped while the hands and arms are better supported so to as to lessen strain on the swimmer. Proper support, during gripping of the board, makes it less tiring for the swimmer during long practice sessions with the board.

DESCRIPTION OF THE PREFERRED EMBODIMENTS

Figure 2:
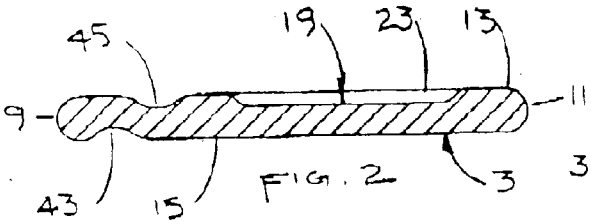
FIG. 2 is a cross-section view taken along line 2—2 in FIG. 1.
Figure 3:
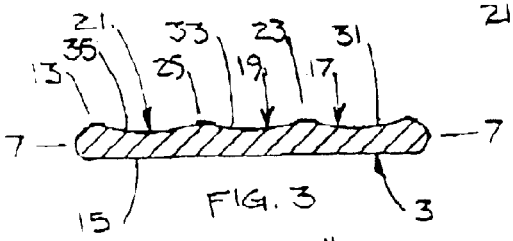
FIG. 3 is a cross-section view taken along line 3—3 in FIG. 1.
Figure 1:
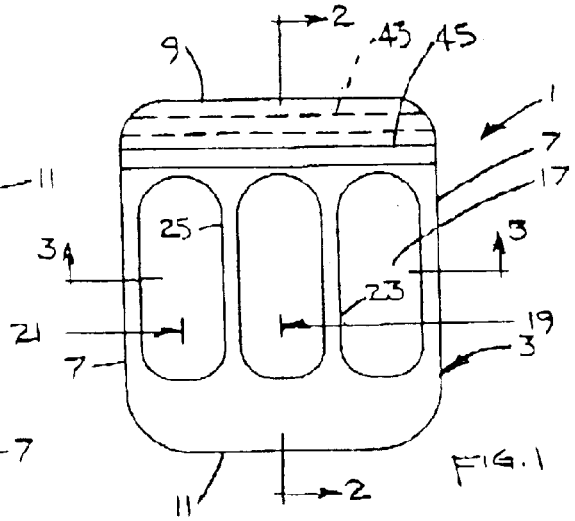
FIG. 1 is a plan view of one embodiment of the kickboard.

In one embodiment of the invention, the kick board 1 has a base 3 as shown in FIGS. 1, 2 and 3. The base 3 is made from suitable rigid thermoplastic material, which is buoyant and floats, and has long side edges 7 joining relatively shorter front and back edges 9, 11 so that the board is longer than it is wider. The side, front and back edges 7, 9, 11 join top and bottom surfaces 13, 15 of the board together. The top and bottom surfaces 13, 15 are generally parallel, as shown in FIGS. 2 and 3, and slightly rounded where they join the edges 7, 9, 11. The kickboard has an overall length that is no more than twenty six inches. The length is preferably between eighteen and twenty two inches.

The top surface 13 of the base 3 has three shallow, wide, depressions 17, 19, 21 formed therein, the depressions extending rearwardly from near the front edge 9 of the base to a position near the back edge 11. The depressions extend over a major portion of the length of the board. The depressions also extend substantially across the width of the board but are separated from each other by interior ribs 23, 25 of base material extending forwardly from the rear portion of the base. The ribs 23, 25 terminate near the front edge of the board. The depressions are wide enough to fully receive the swimmers arms between the sides of each depression. The outer depressions 17, 21, adjacent the side edges 7 of the board, receive the swimmer's arms when the swimmer grasps the front edge 9 of the board with both hands adjacent the side edges 7 during normal swimming practice. The central depression 19 receives one arm of the swimmer when the swimmer grasps the front edge 9 of the board with only one hand, such as when turning off the wall in a pool or when practicing a special kick. The depressions 17, 19, 21 serve to hold the swimmer's arm(s) in position on the board while the arms extend forward to grasp the board, thus lessening strain on the swimmer. The depressions have been shown as extending close to the rear edge 11 of the board. They could however extend right to the rear edge if desired. The ribs 23, 25 are shown as terminating short of the front edge 9 but they could extend to the front edge if desired as could the depressions 17 to 21.

The bottom surfaces 31, 33, 35 of the depressions 17, 19, 21 are preferably concave as seen in transverse cross-section in FIG. 2. The concave curvature allows more of the arm within the depression to be supported, thus spreading out the load on the arm and making use of the board even more comfortable. The concave curvature also helps to more readily retain the arm in position on the board, tending to "cup" the arm as it rests fully within the depression on the board. This is important since the swimmer does not have to strain his arms to maintain them on the board.

Figure 4:
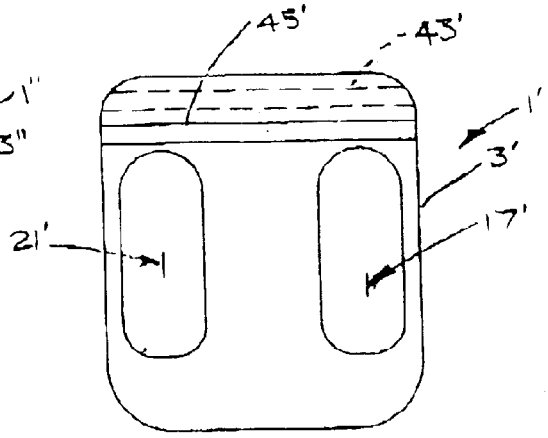
FIG. 4 is a plan view of a second embodiment of the kickboard.

While the board 1 has been shown with three depressions, it could also be made in specialized versions. For example, as shown in FIG. 4, a board 1' could be made with only two depressions 17', 21' in the base 3', the depressions located adjacent the side edges 7' of the base. This board would be used with swimming drills requiring two hands only.

Figure 5:
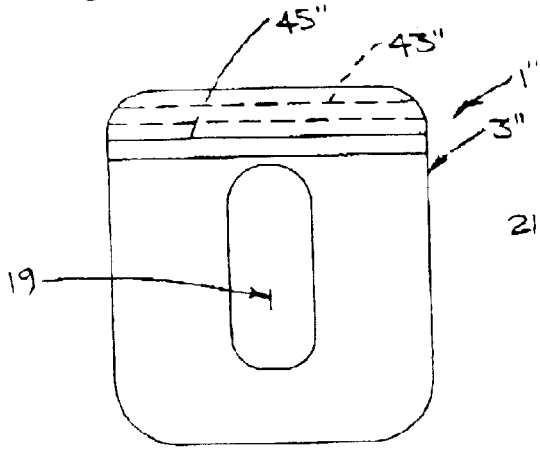
FIG. 5 is a plan view of a further embodiment of the kickboard.

A board 1" could also be made with one central depression 19" in the base 3" as shown in FIG. 5. This board would be used when practicing special swimming strokes that require the board to be held with one hand only.

Figure 6:
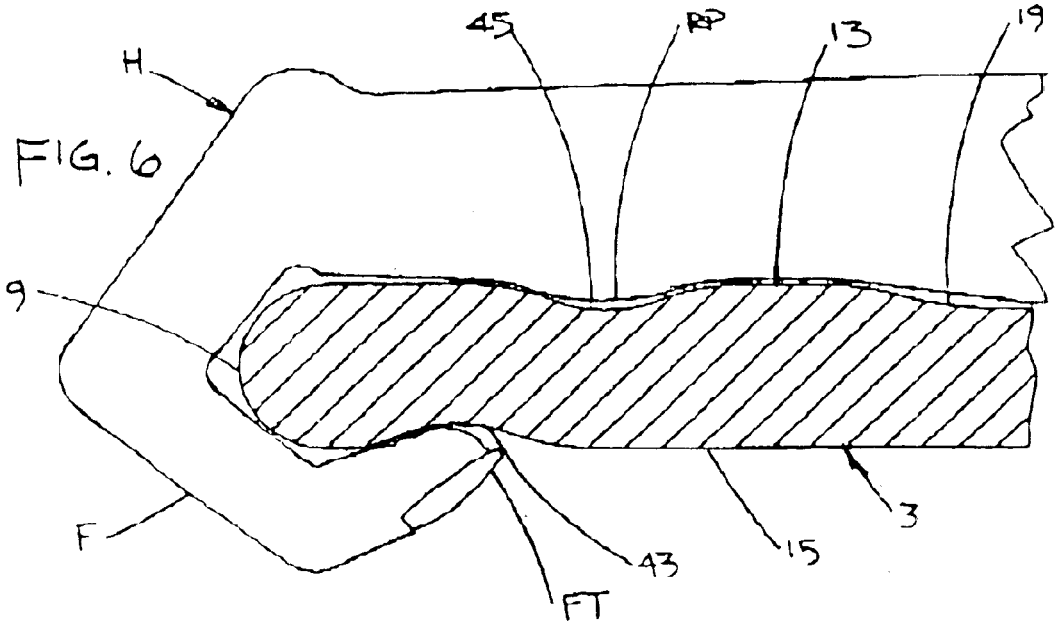
FIG. 6 is a detail cross-section view showing a swimmer's hand gripping the front edge of the kickboard.
Figure 7:
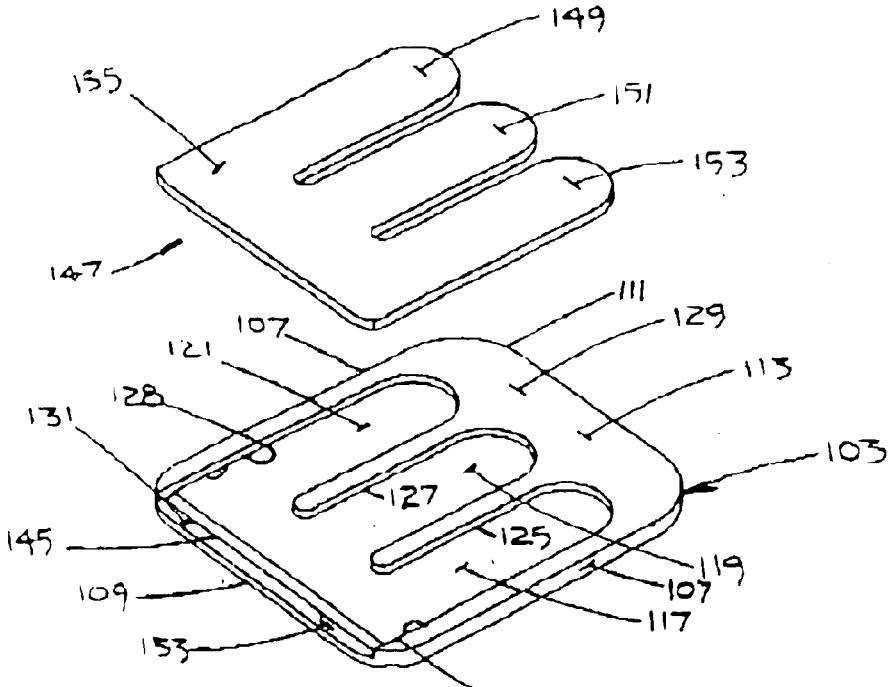
FIG. 7 is an exploded perspective view of a preferred embodiment of the kickboard.
Figure 8:
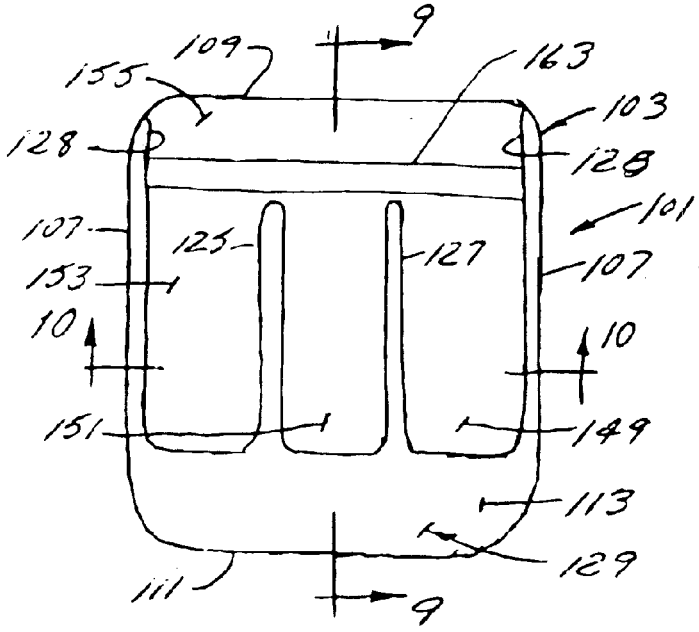
FIG. 8 is a plan view of the kickboard of FIG. 7.
Figure 9:
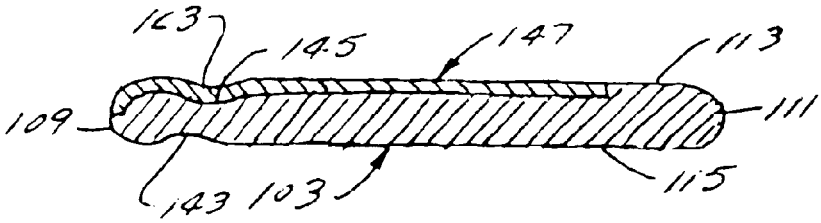
FIG. 9 is a cross-section view taken along line 9—9 in FIG. 8.

The board 1 can be used as described. It is preferred however to provide the board with comfortable hand gripping means. As shown in FIG. 6, the board has a rounded front edge 9 and a shallow, transverse, finger-tip receiving groove 43 in the bottom surface 15 of the base 3. The groove 43 is spaced a short distance from the front edge 9 of the board and is parallel to it. The groove 43 extends substantially across the width of the board and is located to receive the finger tips FT of a swimmer's hands H when he grasps the front edge 9 of the board as shown in FIG. 6.

The board 1 also has a shallow, transverse, rear-palm receiving groove 45 formed in the top surface 13 of the base 3 of the kickboard adjacent the front edge 9. The groove 43 extends across the width of the base and receives the heels of the palms of a swimmer's hands so that the swimmer can comfortably grasp the front edge of the board. The palm-receiving groove 45 is located slightly behind the finger-tip receiving groove 43. The groove 45 is located just in front of the depressions. This second transverse groove 45 is positioned and sized to receive the rear portion RP of the palm of the swimmer's hands as his fingers F are wrapped about the front edge 9 of the kickboard. The top and bottom grooves 43, 45 help relieve stress encountered by the swimmer with his hands in gripping the board. The rear-palm receiving groove 45 allows the swimmer's hands H and forearms to make close contact with the board along the length of his hands and arms thus minimizing localized contact points between his hand and forearm, and the base, which contact points can lead to discomfort. If the depressions and or ribs extend to the front edge, the rear-palm receiving groove 45 in the top surface will be formed in the depressions and pass through the ribs.

The boards 1', 1" can be provided with top and bottom grooves 43', 45' and 43", 45" similar to grooves 43, 45 in board 1. The grooves can extend completely across the width of the boards 1', 1" employing two depressions or one depression respectively, or, the grooves can be positioned to be aligned, in the longitudinal direction of the board, with the depressions in these boards.

To provide greater comfort for the swimmer, it is preferred that the kickboard have a cushioning layer at least in the depressions and preferably at the front of the board as well. As shown in FIGS. 7 to 10, the kickboard 101 has a base 103 with side, front and back edges 107, 109, 111. The edges join top and bottom surfaces 113, 115. Three depressions 117, 119, 121 extend forwardly from near the back edge 111 toward the front edge 109. The depressions 117, 119, 121 are deeper than depressions 17, 19, 21 and are separated by interior ribs 125, 127 which ribs extend from the rear portion 129 of the base and terminate short of the front edge 109. The front portion 131 of the base 103, between the ribs 125, 127 and the front edge 109, and between side edges 128, is thinner than the rear portion 129, its top surface 133 merging with the bottoms of the depressions 117, 119, 121. The bottom surface 115 of the base has a finger-tip receiving groove 143 and the top surface 133 has a rear-palm receiving groove 145. Both grooves 143, 145, extend substantially across the width of the board.

Figure 10:
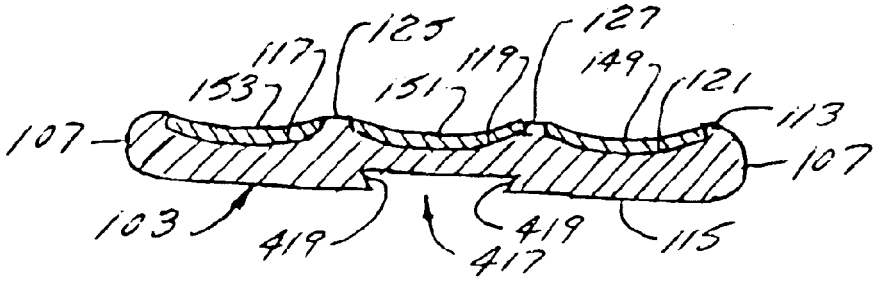
FIG. 10 is a cross-section view taken along line 10—10 in FIG. 8.
Figure 11:
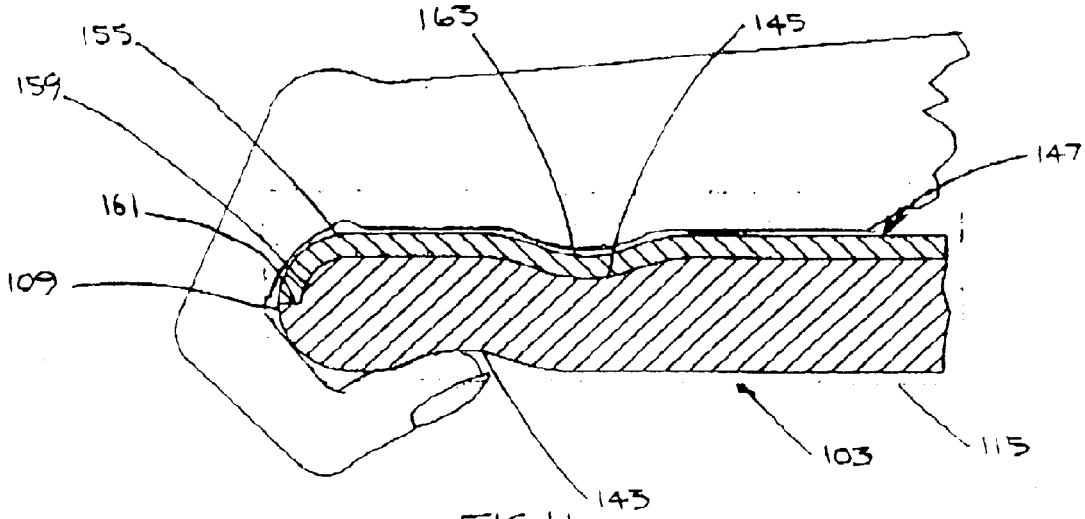
FIG. 11 is a cross-section detail view showing a person's gripping the kickboard shown in FIG. 8.

A layer of cushioning material 147 is placed on the board having fingers portions 149, 151, 153 that fit snugly within the depressions 117, 119, 121 and having a portion 155 that fits on the top surface 133 of the front portion 131 of the base. The portion 155 of the cushioning layer fits part way around the rounded front edge 109 which is cut-away as shown at 159 in FIG. 11, the cut-away portion 159 terminating in an upwardly facing shoulder 161, which the portion 155 of the cushioning layer 147 abuts. The cushioning layer 147 is fastened to the base 3 by suitable adhesive. The cushioning layer 147, of even thickness, follows the contour of the shallow rear-palm receiving groove 145 and presents a shallow rear-palm receiving groove 163 on its upper surface. The bottom surfaces of the depressions are preferably made concave when seen in transverse cross-section so that the top surfaces of the fingers of cushioning material within the depressions are also concave as seen in FIG. 10. The cushioning layer, made of softer material than the base, provides cushioned support for the swimmer's arms are resting in the depressions and for his hands resting on the front of the board and gripping the front edge. The concavity of the cushioning layer fingers in the depressions helps maintain the swimmer's arms in the depressions.

While the cushioning layer has been said to be adhesively joined to the base, it could also be integrally molded to the base during manufacture of the kickboard. The cushioning layer has been shown as terminating on the rounded front edge 109 but it could be extended about the edge to and past the finger-tip receiving groove on the bottom surface of the board if desired.

Figure 12:
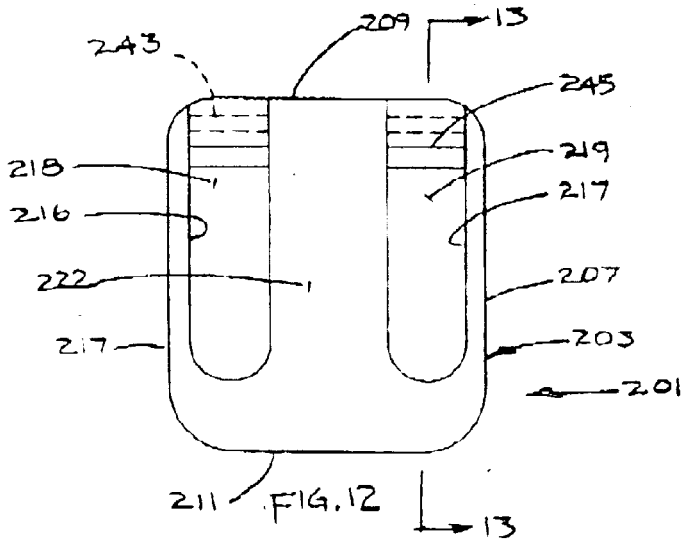
FIG. 12 is a plan view of another embodiment of the kickboard.
Figure 13:
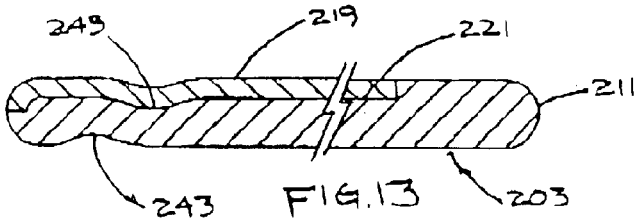
FIG. 13 is a cross-section view taken along line 13—13 in FIG. 12.

The boards shown in FIGS. 4 and 5, with two depressions and one depression, respectively could also be modified and provided with cushioning layers in the same manner if desired. Thus, a kickboard could be made with cushioning means just on the sides of the kickboard for the swimmers forearms. As shown in FIGS. 12 and 13, the kickboard 201 has a base 203 with two depressions 216, 217 extending from the front edge 209 of the base to a position close to the back edge 211 of the base, each depression close to a side 207 of the base. The depressions 216, 217 are separated by a wide, central portion 222 of the base 203 which extends to the front edge 209 of the base, the front edge being rounded. In this embodiment, the finger-tip groove 243 need be formed only under the depressions 216, 217, although it could extend substantially across the width of the base 203. Also, the rear-palm receiving groove 245 need only be formed only in the top surface 221 of the depressions 216, 217 although it could also extend substantially across the width of the base 203. A separate layer of cushioning material 218, 219 is provided in each depression 216, 217, curled over the front edge 209 of the base and following the contour of the top groove 245. In this embodiment, a cushioned grip and forearm support is provided only on the sides of the board.

Figure 14:
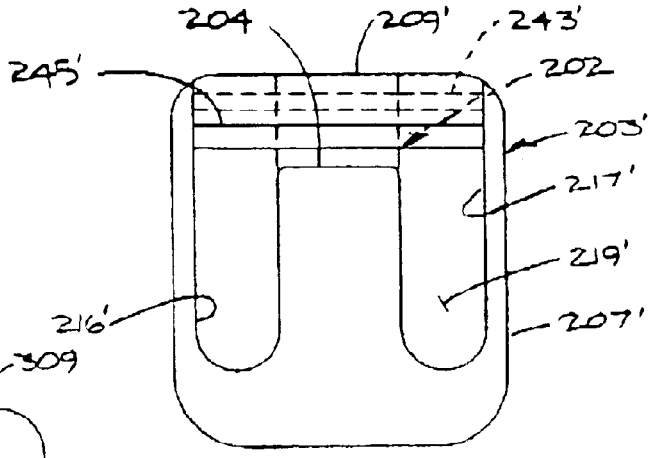
FIG. 14 is a plan view of a further embodiment of the kickboard.

In a further embodiment of the present invention, the kickboard shown in FIGS. 12 and 13 can be modified, as shown in FIG. 14 to have a front, central, portion of the base 203' cut away to same depth as the depressions leaving a front, central cutout portion 202 to join the depressions 216', 217' at the front of the base 203'. In this embodiment, the fingertip-receiving and rear-palm receiving grooves 243', 245' can extend substantially across the width of the board 203' if desired, the rear wall 204 of the central cutout portion 202 being farther away from the front edge 209' than the rear-palm receiving groove 245'. A single piece of cushioning material forms the cushion layer 219' covering both the side depressions 216', 217' and the front, central cutout portion 202 and following the contour of the top groove 245'.

Figure 15:
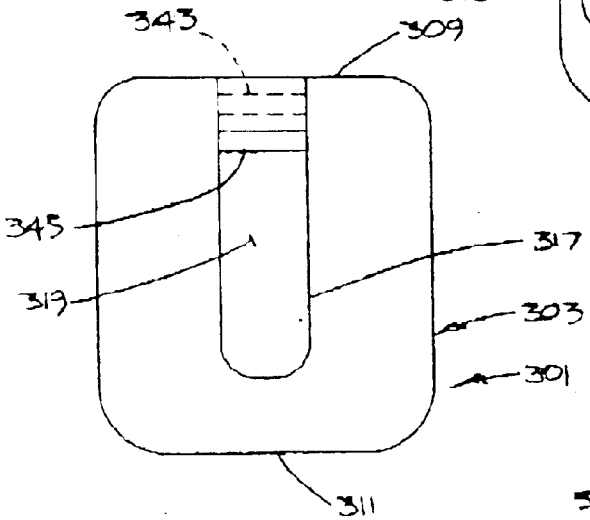
FIG. 15 is a plan view of yet another embodiment of the kickboard.

In a further embodiment, a kickboard 301 could also be made with a narrow central cushioning area where the board is always to be used with only one hand. In this embodiment only a relatively narrow, central depression 317 is provided in the base 303, as shown in FIG. 15, extending rearwardly from the front edge 309 toward close to the rear edge 311 with the fingertip-receiving and rear-palm receiving grooves 343, 345 extending across the central cutout 317 only. A cushioning layer 319 covers the single central cutout 317, following the contour of the groove 345. The front edge of the kickboard, at least in front of the cutout 317, is also cushioned by the cushioning layer and rounded.

Preferably, the bottom surface of the kickboard base, in each embodiment described in this application, is provided with a longitudinal-extending, shallow, central groove 417, as shown in FIG. 10, with the sidewalls 419 of the groove 417 slanted out in an upward direction. This bottom groove 417 helps the board track in a straight line in the water during use. The bottom groove can be used in all the kickboard embodiments disclosed.

Figure 17:
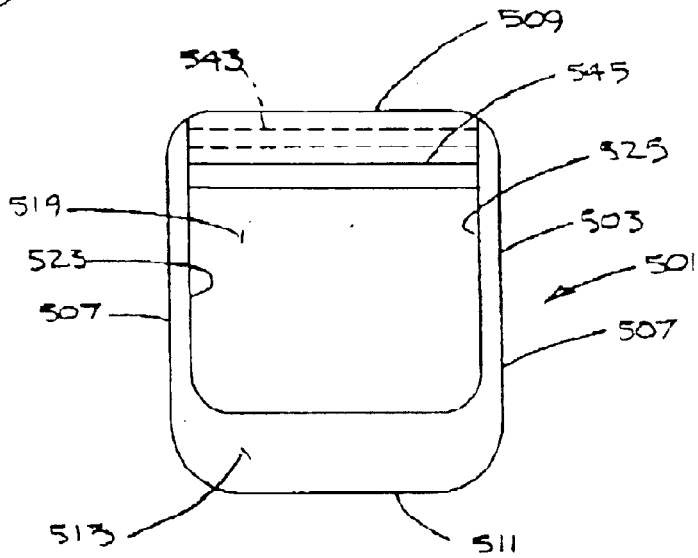
FIG. 17 is a plan view of the assembled kickboard of FIG. 16.
Figure 16:
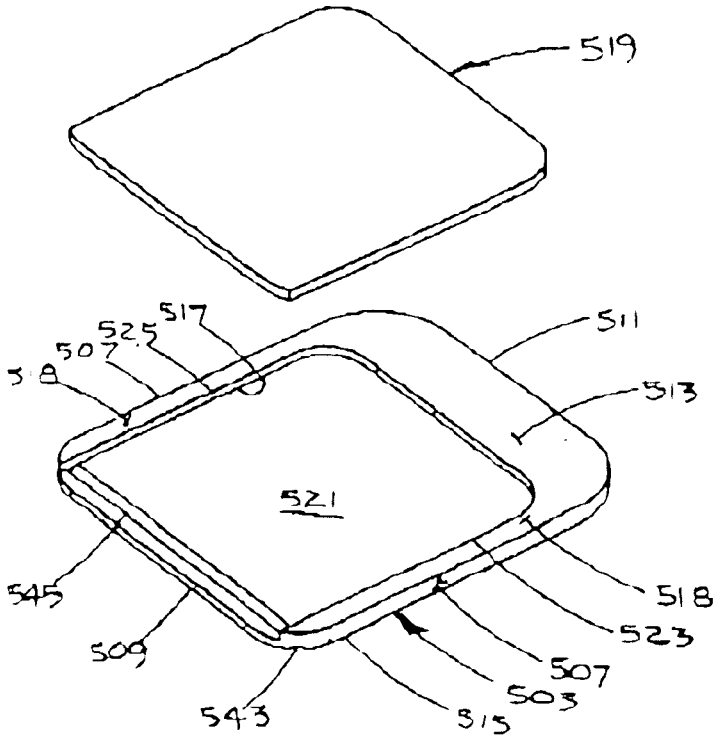
FIG. 16 is an exploded perspective view of yet another embodiment of the kickboard.

In another embodiment of the invention, a kickboard is provided with a single wide layer of cushioning material on the top surface for cushioning a swimmer's arm(s) in any position on the board. This kick board 501 has a base 503 as shown in FIGS. 16 and 17 with side edges 507 joining relatively shorter front and back edges 509, 511. The side, front and back edges 507, 509, 511 join top and bottom surfaces 513, 515 together. The top and bottom surfaces 513, 515 are generally parallel and rounded where they join the edges 507, 509, 511.

The top surface 513 of the base 503 has a shallow, wide, depression 517 formed therein, the depression extending rearwardly from the front edge 509 of the base to a position close to the back edge 511. The depression 517 is also wide, extending close to side edges 518. The kickboard 501 includes a cushion layer 519 of suitable resilient material cut to fill the depression 517. The cushion layer 519 is adhered to the top surface 521 of the depression and to the side and back walls 523, 525 of the depression by suitable adhesive. The front portion of the cushion layer 519 is wrapped part-way about the front edge 509.

The kickboard 501 has a transverse fingertip-receiving groove 543 in the bottom surface 515 of the base 503, the groove 543 spaced a short distance from the front edge 509 of the kickboard and generally parallel to it. The groove 543 extends substantially across the width of the base 503. A second, transverse, palm-receiving groove 545 is formed in the top surface 521 of the cutout 517, the palm-receiving groove being generally parallel with the front edge 509 of the kickboard. The palm-receiving groove 545 is located slightly behind the finger-tip receiving groove 543. The cushioning layer 519 follows the contour of the top surface 521 of the cutout 517, including the top groove 545.

In use, the swimmer grips the front edge 509 of the kickboard adjacent the sides 507 of the base with his hands, his fingers curled over the edge to have his fingertips rest in the fingertip groove 543 and with his arms in outside areas of the cutout 517, adjacent the sides 507. As he grips the board, the rear portions of his palms also rest in the second transverse groove 545 on top of the base. Thus the swimmer can take a comfortable, cushioned grip on the board with two hands during use of the board.

If the swimmer wishes to practice a kick requiring only one hand to grip the kickboard, such as for a side stroke, he grasps the board centrally with one hand gripping the front edge 509 and with the arm in the central portion of the cutout 517. Even using one hand in the center of the board, the swimmer's hand and forearm are still cushioned. The swimmer may also temporarily grasp the board centrally with one hand while turning in a pool to more easily handle the board during the turn.

All the kickboards described have the cushioning layer extending to the front of the board, and in some cases at least part-way about the front edge of the board. Kickboards can be provided however with the cushioning layer terminating short of the front edge so that only the arms of the swimmer are cushioned and not the hands.

Figure 18:
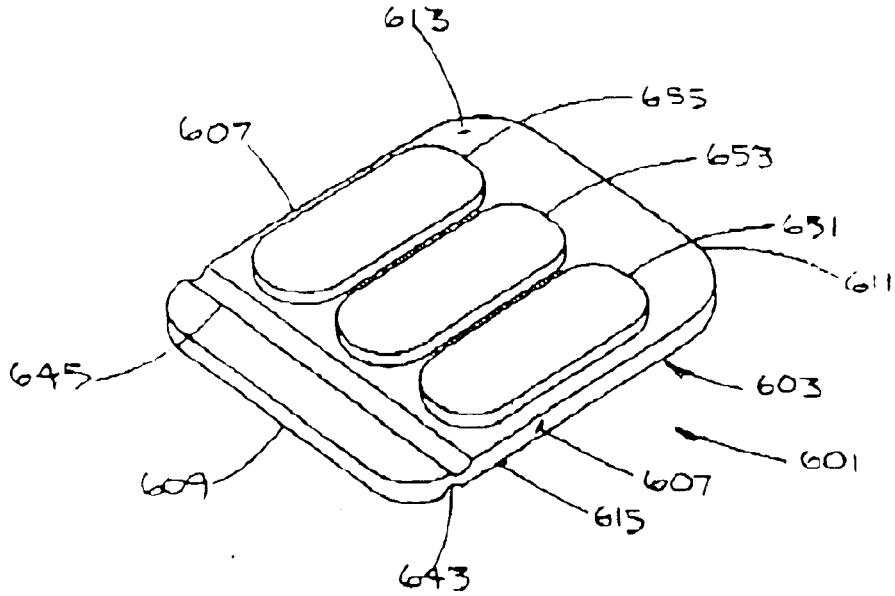
FIG. 18 is a perspective view of another embodiment of the board.

The kickboards described all have the cushion layer for the forearms set in depressions or cutouts formed on the surface of the board. This embodiment is preferred since it streamlines the appearance of the board and does not increase its thickness. However the cushion layer for the forearms could be placed on top of the kickboard without using cutouts. As shown in FIG. 18, the kick board 601 has a base 603 with side edges 607 joining front and rear edges 609, 611, the edges joining top and bottom surfaces 613, 615. The front edge 609 is rounded and there is a finger-tip receiving groove 643 in the bottom surface 615 of the board extending across the board and parallel to it and a rear-palm receiving groove 645 extending across the board in the top surface 613. Strips 651, 653, 655 of cushioning material could be fastened, by suitable adhesive, onto the top surface 613 of the board and extend from close to the rear edge 611 to close to the top groove 645, and even over the front edge and past the bottom groove 643 on the bottom surface, if desired. The strips 651, 653, 655 are spaced across the width of the board and are generally parallel to the side edges 607. A swimmer would use the outside strips 651, 655 when gripping the board with two hands, and would use the central strip 653 when gripping the board with one hand. Thus the board would cushion the swimmers arms and would also provide a comfortable, and cushioned if desired, grip.

The kickboard can be also be made without arm-supporting depressions and without cushioning material if desired. The kickboard would be the same as that shown in FIG. 18 but without the cushioning strips 651, 653, 655 on the top surface of the board. This board, without the cushioning strips, would be provided with the top, rear-palm, receiving groove and the bottom, finger-tip receiving groove. The front edge would be preferably rounded. This board would provide a comfortable grip for a swimmer.

What is claimed is:

1. A kickboard having: a rigid, buoyant, base, the base longer than it is wider and being less t an twenty six inches in length; the base having side edges, a front edge and a back edge; the base having top and bottom surfaces join d together by the side, front and back edges; first and second spaced-apart, shallow, depressions formed in the top surface of the base, one depression adjacent each side edge of the board; the depressions extending rearwardly from at least near the front edge of the base to adjacent the back edge of the base so as to extend over a major portion of the length of the base; the depressions each being at least wide enough to fully receive, and to help retain, the arm of a swimmer between the sides of the depression on the base when the swimmer's arms extend forward to grip the base.

2. A kickboard as claimed in claim 1 having third shallow depression formed in the top surface of the bas the third depression extending rearwardly from at least near the front edge of the base to at least near to the back edge of the base; the third depression being at least wide enough to receive, and to help retain, the arm of a swimmer between the sides of the depression on the base when the swimmer grips the center of the front edge of the base with his hand, the third depression located between the first and second depressions.

3. A kickboard as claimed in claim 1 including a finger-tip receiving groove in the bottom surface of the base just behind the front edge of the base and a rear-palm receiving groove in the top surface of the base parallel to the finger-tip groove and located just behind it, the grooves in front of and transverse to the depressions.

4. A kickboard as claimed in claim 2 including a finger-tip receiving groove in the bottom surface of the base just behind the front edge of the base and a rear-palm receiving groove in the top surface of the base parallel to the finger-tip groove and located just behind it, the grooves in front of and transverse to the depressions.

5. A kickboard as claimed in claim 1 including a cushioning layer in the depressions.

6. A kickboard as claimed in claim 2 including a cushioning layer in the depressions.

7. A kickboard as claimed in claim 3 wherein the front edge is rounded; a cushioning layer in the depressions, the layer extending forwardly over the rear-palm receiving groove and over at least a portion of the rounded front edge of the base.

8. A kickboard as claimed in claim 4 wherein the front edge is rounded; a cushioning layer in the depressions, the layers extending forwardly over the rear-palm receiving groove and over at least a portion of the rounded front edge of the base.

9. A kickboard as claimed in claim 5 wherein the front edge of the base, at least in front of the depressions is rounded; the front of the cushioning layer wrapped about at leas the top part of the front edge of the base to form a rounded cushion front edge on the kickboard.

10. A kickboard as claimed in claim 6 wherein the front edge of the base, at least in front of the depressions is rounded; the front of the cushioning layer wrapped about at leas the top part of the front edge of the base to form a rounded cushion front edge on the kickboard.

11. A kickboard as claimed in claim 9 including a rear-palm receiving groove in the top surface between the depressions and the front edge, the groove covered by the cushioning layer, the groove positioned to receive the rear palm of a swimmer is he grips the rounded edge of the base with his fingers.

12. A kickboard as claimed in claim 10 including a rear-palm receiving groove in the top surface between the depressions and the front edge, the groove covered by the cushioning layer, the groove positioned to receive the rear palms of a swimmer as he grips the rounded edge of the base with his fingers.

13. A kickboard as claimed in claim 1 wherein the first and second spaced-apart depressions are joined by a transverse depression in the top surface of the base at the front of the base, the transverse depression extending across the width of the base.

14. A kickboard as claimed in claim 1 wherein the front portion of the base in front of the depressions is thinner than the remainder of the base and has its top surface merging with the bottom surface of the depressions; and a cushioning layer covering the bottoms of the depressions and at least the top sur ace of the front portion.

15. A kickboard as claimed in claim 14 including a rear palm receiving groove in the top surface of the front portion of the base located just behind the front edge, the groove extending substantially across the width of the base, the cushioning layer covering the rear-palm receiving groove.

16. A kickboard having: a rigid, buoyant, base; the base longer than it is wider and being less than twenty-six inches in length; the base having side edges, a front edge and a back edge joining generally parallel top and bottom surfaces which surfaces define the planar shape of the board; and two cushioning layers on the top surface of the base extending generally rearwardly from at least near the front edge of the base to adjacent the back edge of the base over a major portion of the length o the base; one cushioning layer adjacent each side edge of the base, the cushioning layers sized in length and width, and positioned, to fully cushion the arms of the swimmer when he grasps the front edge of the base with his hands.

17. A kickboard as claimed in claim 16 including a third cushioning layer on the top surface of the base, centrally located on the base between the first two layers and as long as the first two layers, the third layer wide enough to support a swimmer's arm when he grasps the front edge of the base.

* * * * *